United States Patent [19]

Wall, Jr.

[11] 4,305,165

[45] Dec. 15, 1981

[54] PORTABLE SHOWER BATH

[76] Inventor: Louis S. Wall, Jr., 2061 Antoine, Houston, Tex. 77055

[21] Appl. No.: 71,017

[22] Filed: Aug. 30, 1979

[51] Int. Cl.[3] ..... A47K 3/08; A47K 3/06

[52] U.S. Cl. ..... 4/549; 4/538; 4/580; 4/585; 4/619

[58] Field of Search ..... 4/175, 178, 180, 596, 4/615, 585, 612, 613, 619, 557, 597, 558, 580, 528, 538, 539, 549, 551, 541, 542, 544, 546

[56] References Cited

U.S. PATENT DOCUMENTS

| | | | |
|---|---|---|---|
| 2,850,742 | 9/1958 | Glintz | 4/159 |
| 3,013,280 | 12/1961 | Coffman et al. | 4/159 |
| 3,192,537 | 7/1965 | Coffman et al. | 4/159 |
| 3,800,336 | 4/1974 | Hoxeng | 4/177 |
| 3,803,642 | 4/1974 | Erling et al. | 4/177 |
| 4,081,867 | 4/1978 | Simeola | 4/159 |
| 4,170,045 | 10/1979 | Estes | 4/178 X |

*Primary Examiner*—Henry K. Artis

[57] ABSTRACT

Apparatus for aiding in the showering of bathing of bed patients, which apparatus includes disposable non-porous sheets adapted to be fitted within a basin for collecting shower and bath water after use. The basin is removable from the bathing apparatus frame structure so that it may easily be maneuvered under a bed patient, and then used similar to a stretcher to transport the bed patient from the hospital bed to the apparatus support structure. Water collected during the bathing procedure is directed into a holding tank which includes a water pump and drain hose for draining such shower or bath water into an appropriate lavatory drain.

7 Claims, 1 Drawing Figure

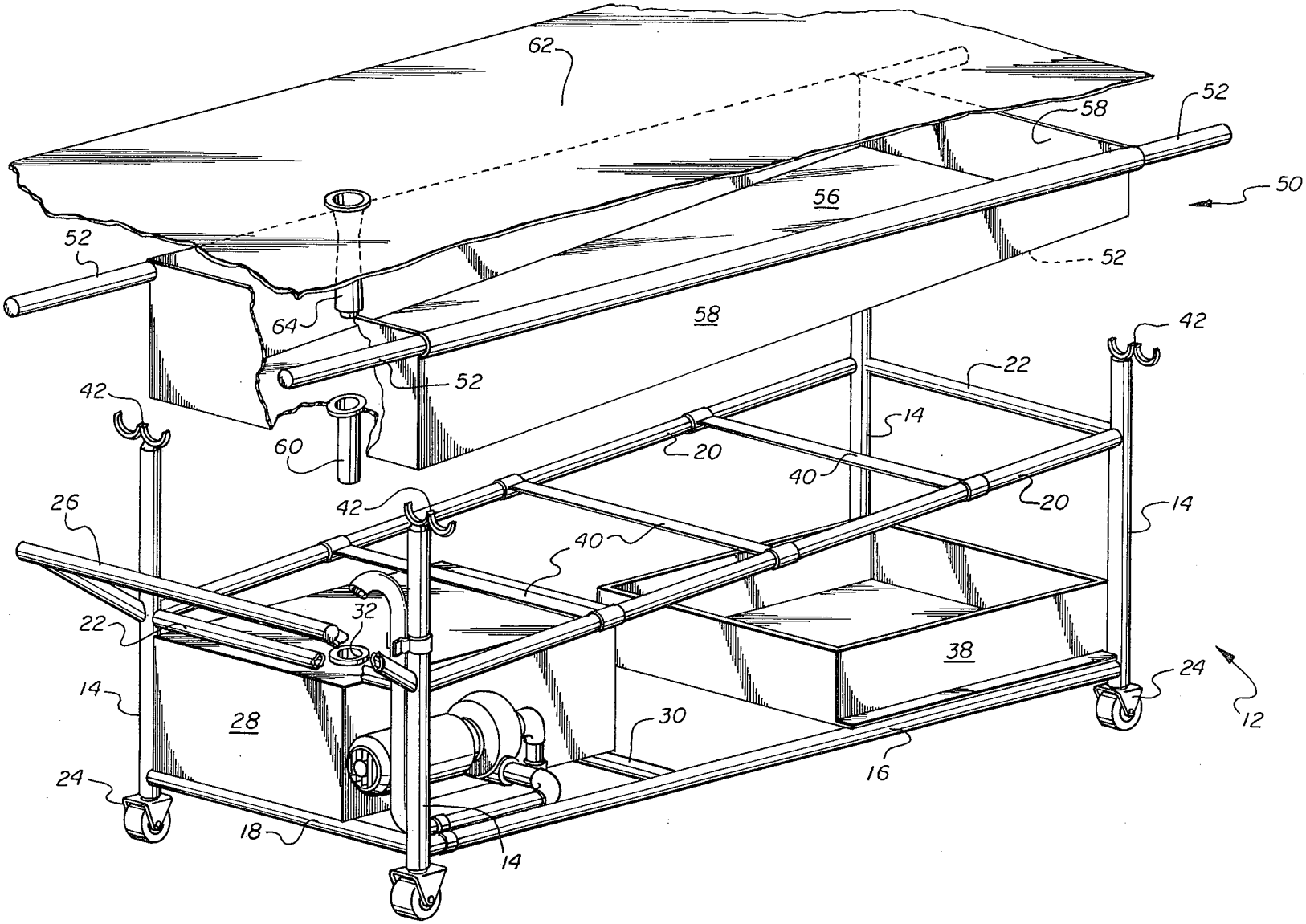
50
52
58
52
56
58
62
52
64
60
52
42
14
22
14
20
40
20
40
42
32
26
22
42
12
24
38
16
30
14
28
18
14
24

PORTABLE SHOWER BATH

BACKGROUND OF THE INVENTION

1. Field of the Invention

This invention relates generally to bathing apparatus for bed patients and more particularly to a portable shower bath apparatus having a disposable catch basin apparatus for collecting shower water used in bathing such bed patients.

2. Description of the Prior Art

Devices for bathing or showering said patients and collecting the water therefrom are not new to this art. For example, U.S. Pat. No. 3,800,336, discloses a portable bed bath having a waterproof sheet attached to a frame to form the bath tub portion. This sheet and frame combination is then positioned above an existing bed surface and supported thereby. Other prior art devices disclosed similar apparatus: a plastic liner that attaches to a bed frame structural member, forming a bath tub over the patient's bed. Other devices incorporate a porous net support member for supporting a bed patient during the shower operation, which permits the shower water to be collected therebelow. Still other devices surround the bed patient in an enclosure, and incorporate a system of spray nozzles within to cleanse the bed patient. All of the prior art devices utilize rather complex mechanisms for supporting the bed patient and/or collecting the shower water after use. In addition, each of the prior art devices disclosed utilizes the "bath tub" repeatedly for each of many patients, giving rise to the possibility of transmitting and/or perpetuating non-sanitary conditions from one bed patient to the next if the "bath tub" is not thoroughly cleaned after each use. Obviously this is a very costly procedure in terms of "non-use" time of a portable shower bath apparatus, and also in terms of labor expended in attempting to thoroughly clean the "bath tub" after each use.

It is therefore an object of the present invention to provide a portable shower bath apparatus for bathing bed-patients, and having a disposable water collecting sheet therein to collect the shower water after use, to prevent the perpetuation of unsanitary conditions.

It is a further object of the present invention to provide a portable shower bath apparatus of simple construction and operation in order to simplify the procedure for bathing and/or showering bed-patients.

SUMMARY OF THE INVENTION

In accordance with the present invention, a portable shower bath is provided, comprising a support frame structure having an upper supporting structure surface for supporting a basin means. The basin means comprises a catch basin defining an enclosure for receiving and supporting a bed-patient during the bathing or showering operation. A non-porous sheet of plastic or the like is fitted into the basin, and includes a drain nozzle therewith which passes through a drain collar in the basin for permitting the shower water to drain from the sheet. The support frame structure carries with it a holding tank having an inlet communicating with the drain nozzle for collecting the shower water after use.

Following the showering procedure, a water pump within the holding tank evacuates the tank by pumping the water therein through a drain hose into a suitable lavatory or the like. Next, the non-porous plastic sheet is removed and disposed of and a fresh one fitted in its place, so that subsequent bed-patients may have a sanitary "bath tub", and will not be exposed to unsanitary conditions inherent in utilizing the same bath tub for showering a number of bed-patients.

BRIEF DESCRIPTION OF THE DRAWING

Other objects and advantages of the present invention will become apparent upon a careful reading of the following detailed description of the invention, the claims and the drawing, which is an exploded perspective view of portable shower bath apparatus of the present invention.

DETAILED DESCRIPTION OF THE INVENTION

Referring now to the drawing, the portable shower bath of the present invention is shown generally illustrated at 10 to comprise a support frame structure 12, a basin means 50 supported by the frame structure and adapted to receive a non-porous sheet of plastic or the like 62, which basin means and sheet define a bath tub-like enclosure for receiving and supporting a bed-patient for purposes of showering and/or bathing. A holding tank 28 is mounted with the support frame structure 12 and communicates with the basin means 50 and sheet 62 to drain shower water therefrom into the tank for disposal elsewhere.

As best shown in the drawing, the support frame structure 12 of the preferred embodiment comprises four vertical frame members 14 connected together by a pair of lower lengthwise interconnecting members 16 and a pair of lower transverse interconnecting members 18 at their respective lower ends, and connected together by a pair of upper lengthwise interconnecting members 20 and a pair of upper transverse interconnecting members 22 at the upper end thereof for forming a rectangular box-shaped shower bath support structure. These frame members and interconnecting members are preferably constructed of a light-weight metal, such as aluminum and are permanently connected together as by welding or brazing, or any other suitable manner to form a rigid frame structure suitable for supporting a light-weight bath tub enclosure and bed-patient therein. Mobility is imparted to the support frame structure 12 by four castors adapted to pivot about the vertical frame member through 360°, to enable the support frame structure 12 to be freely rolled about. A handle 26, typically constructed of the same material as the support frame 12 is attached to one end thereof for maneuvering the frame structure and shower bath about.

As best shown in the drawing, the upper interconnecting members 20 and 22 define a plane which is inclined slightly from horizontal, sloping in a downward direction from left to right as shown in the drawing. The purpose of the inclined surface is to utilize gravity force in draining the shower bath during and after its use.

As shown, the shower bath 10 of the present invention includes a holding tank 28 mounted with the lower interconnecting members 16 and 18 at the right end thereof directly below that portion of the basin means 50 that is lowest relative to a horizontal plane. The holding tank 28 is supported by the right hand transverse interconnecting member 18 and a crossbrace 30 permanently attached to the lengthwise interconnecting members 16 in a suitable manner to support the holding tank and a body of water therein.

As best shown in the drawing, the basin means 50 comprises a pair of support bars 52 to which is attached a basin 54. In the preferred embodiment, the basin 54, comprises a flexible non-porous material, such as rubberized canvas, preformed into an open enclosure having an essentially horizontal lower surface and four vertically oriented side surfaces extending upperwardly therefrom. The lower surface is designed to rest adjacent the upper interconnecting members 20 and 22 of the support frame structure 12, and is further supported by a plurality of safety support straps 40, each of which is attached at each end thereof to an upper transverse interconnecting member 22 in order to provide support for the basin means 50 and a bed-patient positioned therein. These safety support straps 40 may be constructed of a flexible material, such as reinforced canvas, plastic or rubber, or may be constructed of a more rigid material, such as aluminum.

The basin means 50 is positioned upon the support frame structure 12, each of the two support bars 52 resting in a respective bar holder and clamp means 52 for supporting the basin means 50 upon the support frame and retaining same in position. In the preferred embodiment, the bar holder and clamp means 42 comprise adjustable oar-type locks, permitting relative freedom of movement of the support bars 52 therein while retaining the basin means 50 in position; however, any comparable means for supporting and retaining the support bars 52 in position may be utilized.

The non-porous sheet 62 includes a drain nozzle 64 integrally formed therewith for permitting shower water collected therein to drain therefrom. The sheet 62 is adapted to be fitted into the basin means 50 in a manner to enable the sheet to conform to the configuration of the basin means to enable a bed-patient to be positioned therein. The sheet 62 of the present invention is designed to be used once, then discarded in favor of a new, sanitary sheet. In this way, the transmission of disease, germs and other unsanitary conditions is eliminated without the need for costly and time-consuming resterilization of a reusable shower bath.

The basin 54 includes a collar 60 integrally formed therewith and adapted to engage a holding tank inlet 32 when the basin means 50 is in functional position, in order that any water collected therein may normally drain into the holding tank 28. The basin collar 60 is adapted to receive the sheet drain nozzle 64 in order to direct the flow of water collected within the sheet through the drain nozzle 64, the collar 60 and into the holding tank 28 by normal gravitation flow.

A water pump 34 is provided for evacuating the holding tank 28 periodically. The pump outlet is connected to a drain hose 36 which may be conveniently inserted into a lavatory drain or the like for discharging the shower water thereinto after use. The water pump 34 is operated by an electric motor (not shown), and may also include a float switch (not shown) within the holding tank 28 to activate the pump 34 automatically upon the water in the holding tank 28 reaching a predetermined level.

A sheet carrying tray 38 is also included and is removably attached to the support frame structure 12 at the lower section thereof at the end opposite the holding tank 28. This tray 38 may be of any conventional form suitable for carrying a number of non-porous bath sheets 62, and may also include a depository for used sheets.

In operation of the portable shower bath of the present invention, the attendant first installs a non-porous sheet 62 within the basin means 50, being sure to insert the sheet drain nozzle 64 through the basin means collar 60. Next the sheet 62 is formed fitted within the basin means 50, the edges thereof permitted to extend over the support bars 52 and upper edge of the vertical side walls 58 of the basin 54. The portable shower bath is next positioned along side of the hospital bed of the patient to be bathed. The non-porous sheet 62 is then placed under the patient in the customary manner, rolling the patient toward one edge of the bed, placing the basin means 50 upon the upper surface of the bed where the patient was and rolling the patient back onto the basin means. The basin means 50 now functions similar to a stretcher, permitting two attendants to grasp exposed ends of the support bars 52 and lift the patient from the hospital bed and position the basin means upon the support frame structure 12. In such a procedure, the attendants first position the exposed ends of the support bars 52 within respective bar holder and clamp means 42 and clamp or otherwise lock the clamp means onto the support bars to retain the basin means in position upon the support frame structure 12.

If it is not already in position, the basin means collar 60 and enclosed sheet drain nozzle 64 may be inserted into the holding tank inlet 32 at this time. When the basin means 50 is so positioned upon the support frame structure 12, the patient therein is totally supported by the plurality of safety support straps 40, functioning similar to a typical cot or the like. The patient is then bathed or otherwise cleansed using an external hand held shower hose and nozzle. It can be appreciated at this point that the slight incline of the upper surface of the support frame structure 12 causes the water collected within the basin means to drain by gravitation into the holding tank positioned below.

Following the showering or bathing operation, the reverse process is employed to transfer the patient back to his hospital bed. After towel drying the patient, the attendants unlock the clamp means 42 and by means of the support bars 52, lift the basin means 50 and patient back to his hospital bed. The patient is then rolled off to one side and the basin means 50 removed. At this time, an attendant removes and discards the non-porous sheet 62 either into the sheet carrying tray 38 or other appropriate disposable sheet receptacle. The attendants then position the basin means 50 upon the support frame structure 12 as before, and clamp the support bars thereto. Following the installation of a new non-porous sheet 62 as described hereinabove, the portable shower bath 10 of the present invention is now prepared to be relocated to a different hospital bed and used in showering subsequent hospital bed patients, without fear of accompanying unsanitary conditions inherent in using conventional portable baths wherein a number of bed patients are bathed, sequentially, in the same bath. Rather, a new, sterilized "bath tub" is provided after each use to insure against the transmission unsanitary conditions.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

The invention having been described, what is claimed is:

1. A portable shower bath apparatus for bathing a bed-patient, comprising:

(a) a non-porous sheet having a drain nozzle integrally formed therewith;

(b) a basin for receiving and supporting said sheet and having a collar integrally formed therewith for receiving said drain nozzle;

(c) a mobile support structure for receiving and supporting said basin; and (d) a holding tank carried by said support structure and having an inlet communicating with said drain nozzle for collecting drain water from said sheet.

2. The shower bath apparatus as set forth in claim 1, further comprising a pump and discharge hose mounted with said holding tank for discharging the drain water collected in said tank therefrom.

3. The shower bath apparatus as set forth in claim 2, further comprising a sheet carrying tray for carrying a supply of said non-porous sheets.

4. The shower bath apparatus as set forth in claim 3, wherein said basin comprises:

(1) two parallel horizontal bars; and (2) a flexible material mounted with said bars and having an essentially horizontal lower surface and four vertically oriented side surfaces defining an enclosure for receiving said non-porous sheet, wherein said collar is integrally formed with said lower surface, and wherein said horizontal bars extend from said flexible material sufficiently to enable a person to grasp an end thereof for transporting a bed-patient carried in said basin.

5. The shower bath apparatus as set forth in claim 4, wherein said basin lower surface is inclined slightly from horizontal.

6. The shower bath apparatus as set forth in claim 5, wherein said support structure includes a plurality of safety straps mounted therewith for supporting said basin lower surface and for indirectly supporting a bed-patient within said basin.

7. The shower bath apparatus as set forth in claim 6, wherein said support structure includes locking means for engaging said basin horizontal bars and releasably locking said bars to said support structure.

* * * * *